US009565905B2

(12) United States Patent
Huang et al.

(10) Patent No.: US 9,565,905 B2
(45) Date of Patent: Feb. 14, 2017

(54) LOWER STOP ASSEMBLY FOR QUICK RELEASE SLIDE FASTENERS

(71) Applicant: KEE (GUANGDONG) GARMENT ACCESSORIES LTD., Forshan, Guangdong (CN)

(72) Inventors: Shengchang Huang, Guangdong (CN); Jerry Wang, Guangdong (CN)

(73) Assignee: KEE (GUANGDONG) GARMENT ACCESSORIES LTD., Foshan, Guangdong (CN)

( * ) Notice: Subject to any disclaimer, the term of this patent is extended or adjusted under 35 U.S.C. 154(b) by 0 days.

(21) Appl. No.: 14/100,171

(22) Filed: Dec. 9, 2013

(65) Prior Publication Data

US 2014/0201958 A1 Jul. 24, 2014

Related U.S. Application Data

(63) Continuation-in-part of application No. PCT/CN2013/073494, filed on Mar. 29, 2013.

(30) Foreign Application Priority Data

Jan. 21, 2013 (CN) ..... 2013 1 0021112

(51) Int. Cl.
*A44B 19/36* (2006.01)
*A44B 19/38* (2006.01)

(52) U.S. Cl.
CPC ..... *A44B 19/36* (2013.01); *A44B 19/38* (2013.01); *A44B 19/386* (2013.01); *A44B 19/388* (2013.01); *Y10T 24/2593* (2015.01); *Y10T 24/2596* (2015.01)

(58) Field of Classification Search
CPC ..... A44B 19/38; A44B 19/388; Y10T 24/25; Y10T 24/2598; Y10T 24/2593
See application file for complete search history.

(56) References Cited

U.S. PATENT DOCUMENTS 3,752,718 A * 8/1973 Potin ..... A44B 19/38 156/66
5,755,014 A * 5/1998 Yamaguchi ..... A44B 19/38 24/388

FOREIGN PATENT DOCUMENTS

CN 1170551 A 1/1998
CN 2489625 Y 5/2002
CN 101152030 A 4/2008
(Continued)

*Primary Examiner* — Robert J Sandy
*Assistant Examiner* — Michael Lee
(74) *Attorney, Agent, or Firm* — Jackson IPG PLLC; Demian K. Jackson

(57) ABSTRACT

A lower stop assembly for slide fasteners comprises a left stop member and a right stop member. The inside of the right stop member is provided with a right slot and an annular orifice both extending in the direction of the inside, the annular orifice being located at the front end of the right slot and in direct communication with an opening of the right slot. The left stop member can be movably inserted into the opening of the right slot and then released from lateral notches of the right slot. As the left stop member can be released from the lateral notches of the right slot, when the left stop member needs to retreat from the right slot, the left stop member may rotate around the outer lateral wall of the annular orifice under the drive of the left slide fastener belt to come out from the right slot.

3 Claims, 6 Drawing Sheets

(56) References Cited

FOREIGN PATENT DOCUMENTS

CN 102106630 A 12/2009

* cited by examiner

LOWER STOP ASSEMBLY FOR QUICK RELEASE SLIDE FASTENERS

FIELD OF THE INVENTION

The invention relates to a lower stop assembly for quick release slide fasteners, in particular to a lower stop assembly for quick release slide fasteners, which can effectively provide a locking effect of the lower end of the slide fasteners and a quick release effect of the slide fasteners.

BACKGROUND OF THE INVENTION

As fasteners for clothes and other fabrics, slide fasteners have been well known. To be applied to fabrics, slide fasteners generally comprise a lower stop assembly. The lower stop assembly, generally disposed at the end of a slide fastener where a slider starts from, is mainly used for fastening the separated left and right slide fasteners together before the slider starts so as to bring convenience for the slider of the slide fastener to fasten the slide fastener.

In the prior art, Chinese Utility Model Publication No. CN2489625Y disclosed a lower stop structure with anti-pull effect for slide fasteners (as shown in FIG. 9). The lower stop structure for slide fasteners also comprises a left stop member 101 and a right stop member 102, the inside of the right stop member 102 being provided with a right slot 103 and an annular orifice 104 extending in the direction of the inside, the annular orifice 104 being located at the front end of the right slot 103 and in direct communication with an opening 105 of the right slot 103, the right slot 103 being provided with a lateral notch 106; and, the top end portion 107 of the left stop member 101 can be inserted into the annular orifice 104 when the left stop member 101 is inserted into the opening 105 of the right slot 103. However, as described in the PCT International Search Report, the left stop member 101 is unable to depart from the lateral notch 106 quickly as the width of the lateral notch 106 is less than the thickness of the left stop member 101. Therefore, the structure in the prior art is unable to provide for users an effect of quickly opening the lower stop assembly of the slide fastener.

In another prior art, Chinese Patent Application No. CN101152030A disclosed a slide fastener with separable bottom end stop (as shown in FIG. 10), comprising a slider through which fastener element rows of a pair of right and left slide fastener belts pass and a separable bottom end stop, wherein a fitting body 201 is provided on one slide fastener belt while a pivot stopper body 202 capable of engaging with the fitting body 201 is provided on the other slide fastener belt; the pivot stopper body has a pivot stopper portion 203 that is capable of rotatably engaging with the fitting body 201 by fitting the fitting body 201 in the pivot stopper portion 203 from a side portion of the pivot stopper body 202 and capable of rotatably engaging with the fitting body 201 by inserting the fitting body 201 in the pivot stopper portion 203 through a fastener element guide passage from a shoulder mouth of the slider. The bottom end stop end of this structure generally is the so-called lower stop assembly. This bottom end stop can realize quick release. However, the fitting body 201 is just partially held in a groove 204 and a slit 205 of the pivot stopper body 202, and a portion 206 thereof to be pivoted requires no poisoning and limitation in the up-down direction; in addition, as the pivot stopper portion 203 of the bottom end stop is shaped like a hook, thus actually shaped like a cantilever, it is easy to break; and the intensity of the portion 206 thereof to be pivoted in the up-down direction has high risk. Particularly, when such slide fastener is applied to occasions of high-intensity physical sports, a fitting plate portion 207 inserted into the groove 204 and the slit 205 and located on the fitting body 201 is easy to crack as it is too thin.

SUMMARY OF THE INVENTION

To solve the problems in the prior art, the invention provides a lower stop assembly for slide fasteners, comprising a left stop member and a right stop member. The outsides of the left stop member and the right stop member are connected with a left slide fastener belt and a right slide fastener belt, respectively. The inside of the right stop member is provided with a right slot and an annular orifice both extending in the direction of the inside, the annular orifice being located at the front end of the right slot and in direct communication with an opening of the right slot. The left stop member can be movably inserted into the opening of the right slot and then released from a lateral notch of the right slot. When the left stop member is inserted into the opening of the right slot, the top end part of the left stop member can be inserted into the annular orifice.

Compared with the prior art, the above structure has the following advantages:

1. As the annular orifice is located at the front end of the right slot and in direct communication with the opening of the right slot, it is equivalent that the front end of the right slot is closed actually, so that the strength of the connection structure of upper and lower walls of the right slot is improved greatly by the outside wall of the annular orifice; in turn, the structure strength of the annular orifice is also strengthened by the upper and lower walls of the right slot.

2. As the top end portion of the left stop member can be inserted into the annular orifice, the annular orifice can accommodate the top end portion of the left stop member, so that positioning of the left stop member in both the upper and lower directions, even in both the front and rear directions, can be realized.

3. As the left stop member can be movably inserted in the opening of the right slot, the left stop member is accommodated in the right slot; as a result, the right slot can provide positioning of the left stop member in both the upper and lower directions. Consequently, the left stop member is unlikely to be damaged. The structure becomes compact due to the combination of the right slot and the left stop member.

4. As the left stop member can be released from the lateral notch of the right slot, the left stop member has a short route when retreating from the right slot and the annular orifice. The left stop member may rotate around the outside wall of the annular orifice under the drive of the left slide fastener belt to come out from the right slot, so it is very convenient for the left stop member to retreat from the right slot.

It is to be noted that, terms Left, Right, Front, Rear, Inner and Outer defined in the above solution are all relative definitions of direction.

As a further technical solution, the length of the top end portion of the left stop member that can be inserted into the annular orifice is less than the depth of the opening of the right slot. As the length of the top end portion is less than the depth of the right slot, the left stop member may rotate around the outside wall of the annular orifice under the drive of the left slide fastener belt to come out from the right slot, instead of retreating any route along the original way when the left stop member needs to retreat from the right slot. It is convenient and quick for the left stop member to retreat from the right slot. During the rotation, the top end portion will not encounter any obstruction from the inside wall of the right slot. The length of the top end portion of the left stop member that can be inserted into the annular orifice, in other words, the depth of the left stop member able to inserted into the annular orifice, may be limited by the left slide fastener belt connected to the left stop member, and may also be limited by the model of the annular orifice.

As a further technical solution, the left stop member comprises an inside wall portion that can be inserted into the opening of the right slot, an outside wall portion connected with the slide fastener belts and a middle transition portion located between the inside wall portion and the outside wall portion. The top end of the inside wall portion of the left stop member is provided with a top end portion extending upward in the inside direction of the left stop member so that the top end of the left stop member is L-shaped. When the left stop member is inserted into the opening of the right slot, the top end portion can be inserted into the annular orifice and the wall of the top end of the left stop member is against the outside wall of the annular orifice. In this way, the depth of the left stop member inserted into the annular orifice may be limited by the height of the top end portion.

In the above solution, to ensure that the top end portion can be inserted into and then retreated from the right slot in a rotating way smoothly, the inside of the top end of the top end portion is designed into an arched transition shape.

As a further technical solution, the height of the top end portion is less than the depth of the opening of the right slot. In this way, the top end portion is free from obstruction from the inside wall of the right slot when retreating from the annular orifice in a rotating way.

As a further technical solution, the front end of the lateral notch of the right slot is provided with an upper extension arm and a lower extension arm extending relative to each other. The clearance space between the upper extension arm and the lower extension arm forms a front lateral notch of the right slot. The thickness of the inside wall portion of the left stop member is greater than that of the middle transition portion. The spacing of the front lateral notch of the right slot is less than the thickness of the inside wall portion but greater than the thickness of the middle transition portion. The spacing of the remaining lateral notches of the right slot is greater than the thickness of the inside wall portion.

According to the solution, the lateral notches of the right slot are actually shaped like steps, wherein the spacing of the front lateral notch is less than that of the remaining lateral notches, and the inside wall portion may also be limited within the front lateral notch. In this way, the inside wall portion of the left stop member is accommodated in the right slot when the left stop member is inserted into the opening of the right slot. By the inside wall portion and the top end portion, the transverse tensile strength between the left stop member and the right stop member is improved greatly. When the left stop member needs to retreat from the right slot, the left stop member may rotate around the step of the front lateral notch directly to come out from the right slot after retreating the distance of the front lateral notch under the drive of the left slide fastener. It is convenient and quick for the left stop member to retreat from the right slot. In addition, the upper extension arm and the lower extension arm can also improve the structure strength of the lateral notches to prevent the right slot from cracking due to the impact of external force.

As a further technical solution, the thickness of the top end portion is less than the spacing of the front lateral notch. In this way, when the left stop member needs to retreat, when the inside wall portion retreats from the front lateral notch, the top end portion may slip off the front lateral notch directly, while the remaining parts of the left stop member may slip off the remaining lateral notches directly.

An another implementation way, the lateral notches of the right slot are provided with an upper extension arm and a lower extension arm extending relative to each other. The clearance space between the upper extension arm and the lower extension arm forms the lateral notches of the right slot. The thickness of the rear inside wall portion of the left stop member is greater than that of the middle transition portion so that a rear inside step of the left stop member is formed. The spacing of the lateral notches of the right slot is less than the thickness of the rear inside step but greater than the thickness of the middle transition portion, and is also greater than the thickness of the remaining parts of the inside wall portion of the left stop member. According to the solution, when the left stop member is inserted into the opening of the right slot, as the rear inside step can be limited within the right slot, the transverse tensile strength between the left stop member and the right stop member is improved greatly through the rear inside step and the top end portion. When the left stop member needs to retreat from the right slot, the left stop member may directly slip off the right slot in a rotating way after retreating the distance of the rear inside step under the drive of the left slide fastener belt. It is convenient and quick for the left stop member to retreat from the right slot.

As a further technical solution, the insides of the tail ends of the left stop member and the right stop member are provided with fastening devices that are fastened with each other. In this way, the tail ends of the left stop member and the right stop member may be fastened and positioned with each other in the aid of the fastening devices.

Compared with the prior art, the left stop member and the right stop member of the lower stop assembly provided in this invention may be positioned reliably with each other in the upper, lower, inside and outside directions when the slide fastener is locked; the connection structure is high in strength; and it is quite easy to realize quick release. With the above characteristics and advantages, the invention can be applied to the lower stop assembly of slide fasteners.

DETAILED DESCRIPTION OF THE INVENTION

The specific embodiments of the invention will be further described as below with reference to drawings.

Figure 1:
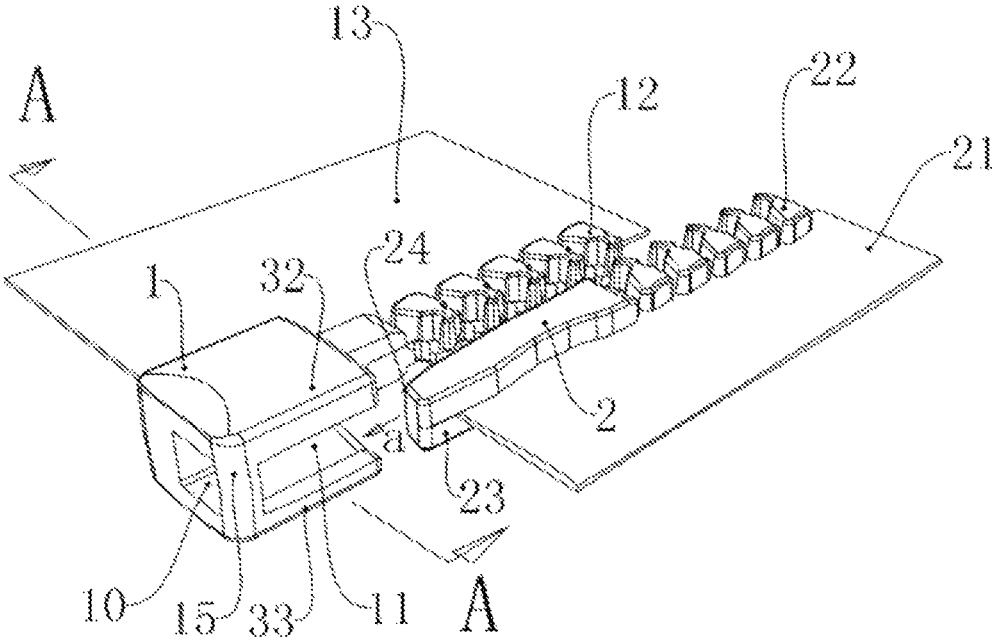
FIG. 1 is a first structure diagram of a lower stop assembly for slide fasteners in the invention.
Figure 2:
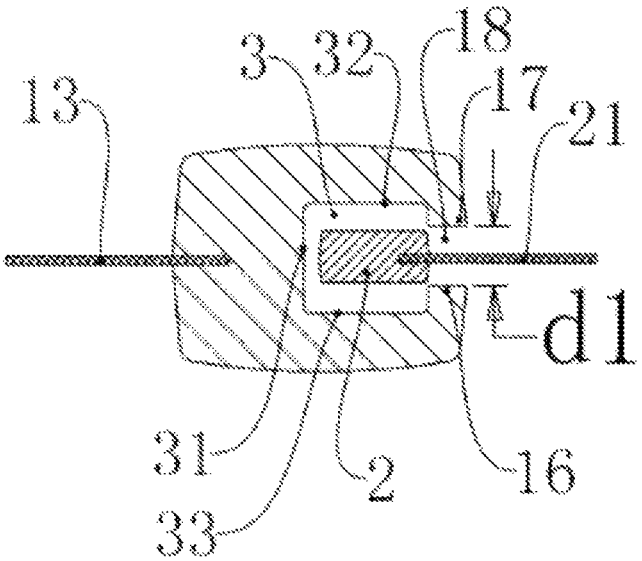
FIG. 2 is a sectional view of A-A direction after the left stop member 2 of FIG. 1 is inserted into the right stop member 1.

As shown in FIG. 1 and FIG. 2, a lower stop assembly for slide fasteners is provided, comprising a left stop member 2 and a right stop member 1. The outsides of the left stop member 2 and the right stop member 1 are connected with a left slide fastener belt 21 and a right slide fastener belt 13, respectively. The left stop member and the right stop member are connected in an injection molding way. The insides of the left slide fastener belt 21 and the right slide fastener belt 13 are also connected in an injection molding way with left fastener teeth 22 and right fasten teeth 12 that can be fastened with each other. When the slide fastener is locked, a slider (not shown) is placed at the tail end of the right stop member 1 at first, and then the left stop member 2 is guided through the slider and then inserted into the right stop member 1, and finally the slider is pulled to lock the left fastener teeth 22 and the right fasten teeth 12 together. It is to be noted that, terms Left, Right, Front, Rear, Inner and Outer defined in the above solution are relative definitions of direction.

As shown in FIG. 1 and FIG. 2, the inside of the right stop member 1 is provided with a right slot 11 and an annular orifice 10 both extending in the direction of the inside. The annular orifice 10 is located at the front end of the right slot 11. The annular orifice 10 is in direct communication with a passage formed by the right slot 11, throughout the tail end and the front end of the right stop member 1. The lateral notches 18 of the right slot 11 face the inside of the right stop member 1. In this structure, an opening 3 of the right slot 11 comprises an inside wall 31, an upper slot wall 32 and a lower slot wall 33. The part of the lateral notches 18 of the right slot 11 is provided with an upper extension arm 17 and a lower extension arm 16 extending relative to each other. The clearance space between the upper extension arm 17 and the lower extension arm 16 forms the lateral notches 18 of the right slot 11.

The difference between the annular orifice 10 and the right slot 10 is that the annular orifice 10 is provided with an outside wall 15 by which the upper slot wall 32 and the lower slot wall 33 are connected together. In this way, the annular orifice 10 can be used for accommodating the top end portion 23 of the left stop member 2 to realize positioning of the top end portion 23 of the left stop member 2 in the upper, lower, front and rear directions; in addition, the outside wall 15 of the annular orifice 10 greatly improves the strength of the connection structure of the upper and lower slot walls (32, 33) of the opening 3 of the right slot 11. In turn, the upper extension arm 17, the lower extension arm 16 and the upper and lower slot walls (32, 33) also strengthen the structure strength of the annular orifice 10.

As shown in FIG. 1 and FIG. 2, the left stop member 2 can be movably inserted into the opening 3 of the right slot 11 front the tail end of the right stop member 1 or from the inside of the right stop member 1 in direction a. The top end portion 23 of the left stop member 2 can also extend to be inserted into the annular orifice 10. The left stop member 2 is accommodated within the opening 3 of the right slot 11. The upper and lower slot walls (32, 33) of the opening 3 can reliably limit the movement of the left stop member 2 in the up-down direction. The depth of the top end portion 23 of the left stop member 2 inserted into the annular orifice 10 may be positioned in a way of making the left slide fastener belt 21 against the outside wall 15, and may also be positioned by changing the fitting shape of the annular orifice 10 and the top end portion 23 appropriately. That is, the insertion depth of the top end portion 23 is limited by the annular orifice 10.

The height of the left stop member 2 is less than the height dl of the lateral notches 18. As a result, when the left fastener teeth 22 and the right fasten teeth 12 are separated (the slider is opened or split manually), the left stop member 2 can rotate around the outside wall 15 of the annular orifice 10 under the drive of the left slide fastener belt 21 so as to slip off the lateral notches 18. It is very convenient for the left stop member to retreat from the lateral notches 18.

To avoid the occurrence of locking between the top end portion 23 of the left stop member 2 and the inside wall 31 of the right slot 11 when the left stop member 2 retreats, in one solution, the top end inside part 24 of the top end portion 23 is designed into an arched transition shape, while in another solution, the height of the top end portion 23 protruded relative to the left slide fastener belt 21 is designed to be less than the slot depth of the opening 3 of the right slot 11. The slot depth is a distance from the inside wall 31 to the lateral notches 18. In this way, the left stop member 2 may rotate around the outside wall 15 of the annular orifice 10 under the drive of the left slide fastener belt 21 to come out from the lateral notches 18, instead of retreating any route along the original way when the left stop member 2 retreats from the right slot 11. It is convenient and quick for the left stop member to retreat from the right slot. During the rotation, the top end portion 23 will be free from any obstruction from the inside wall 31 of the right slot 11.

Figure 3:
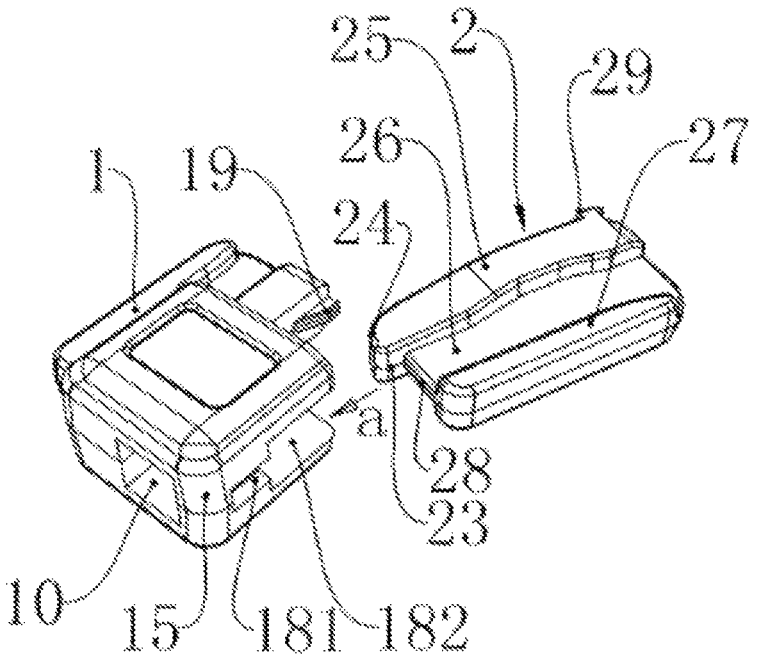
FIG. 3 is a second structure diagram (slide fastener belts and teeth are not shown) of a lower stop assembly for slide fasteners in the invention.
Figure 4:
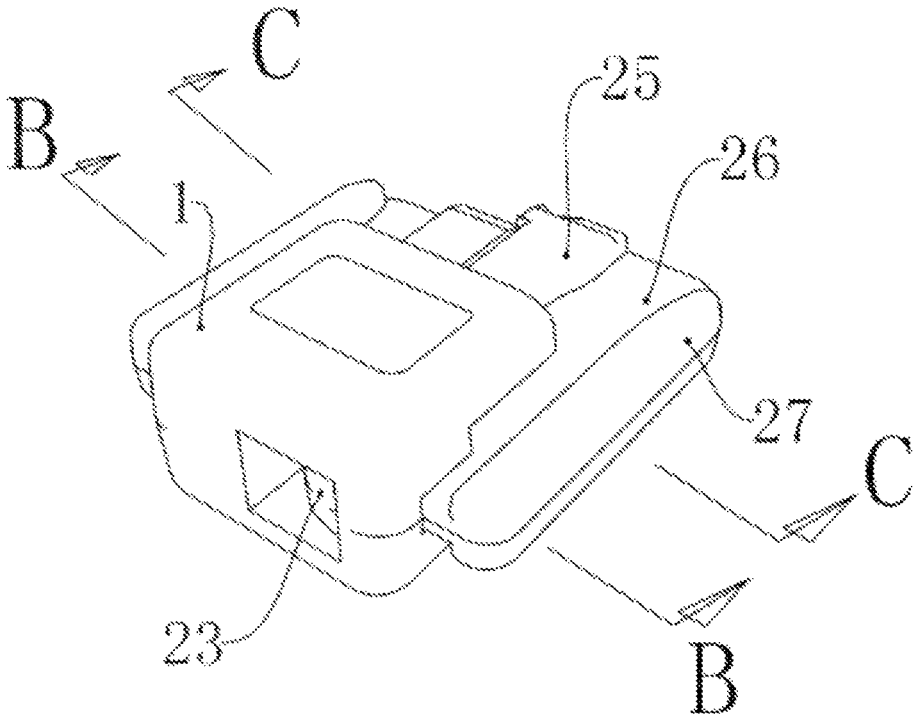
FIG. 4 is a structure diagram of the lower stop assembly of FIG. 3 after the left stop member 2 is inserted into the right stop member 1.
Figure 5:
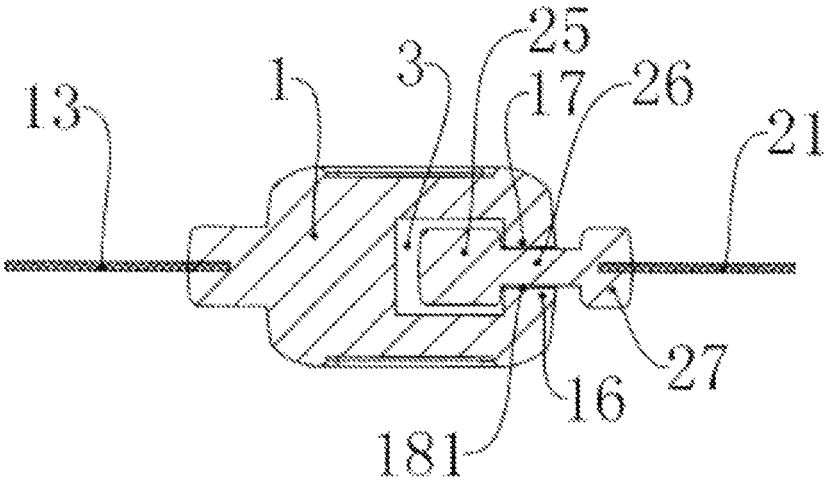
FIG. 5 is a sectional view of B-B direction in FIG. 4.
Figure 6:
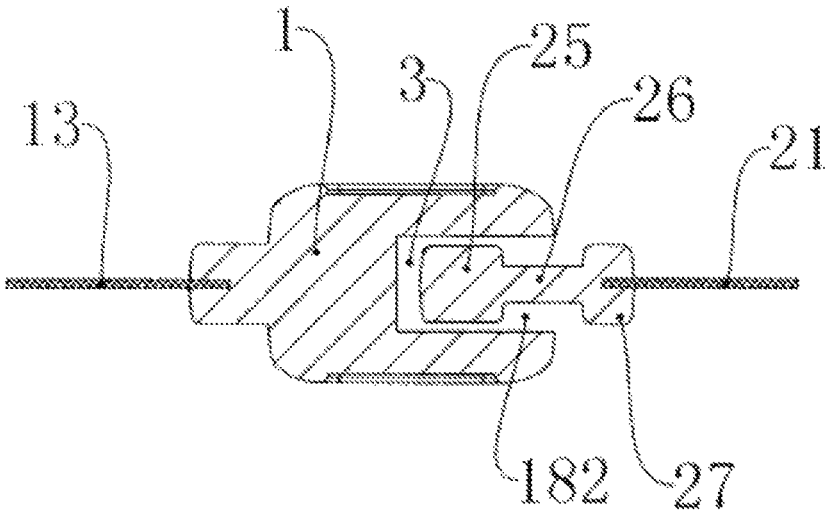
FIG. 6 is a sectional view of C-C direction in FIG. 4.

The second implementation structure is as shown in FIG. 3 and FIG. 4. The left stop member 2 comprises an inside wall portion 25 that can be inserted into the opening 3 of the right slot 11, an outside wall portion 27 connected with slide fastener belts, and a middle transition portion 26 located between the inside wall portion 25 and the outside wall portion 27. The top end of the inside wall portion 25 of the left stop member 2 is provided with a top end portion 23 extending upward in the direction of the inside of the left stop member 2, so that the top end of the left stop member 2 is L-shaped. When the left stop member 2 is inserted into the opening 3 of the right slot 11 provided on the right stop member 1, the inside wall portion 25 of the left stop member 2 is accommodated in the opening 3 of the right slot 11. The top end portion 23 can be inserted into the annular orifice 10 and the top end wall 28 of the left stop member 2 is against the outside wall 15 of the annular orifice 10. The depth of the left stop member 2 inserted into the annular orifice 10 may be limited by the height of the top end portion 23 itself or by the top end wall 28. The height of the top end portion 23 protruded relative to the top end wall 28 is less than the depth of the right slot 11. In this way, the top end portion 23 will be free from any obstruction from the inside wall 31 of the right slot 11 when retreating the annular orifice 10 in a rotating way. In the above solution, to ensure that the top end portion 23 can be inserted into and then retreated from the annular orifice 10 in a rotating way smoothly, the top end inside part 24 of the top end portion 23 is designed into an arched transition shape.

Figure 7:
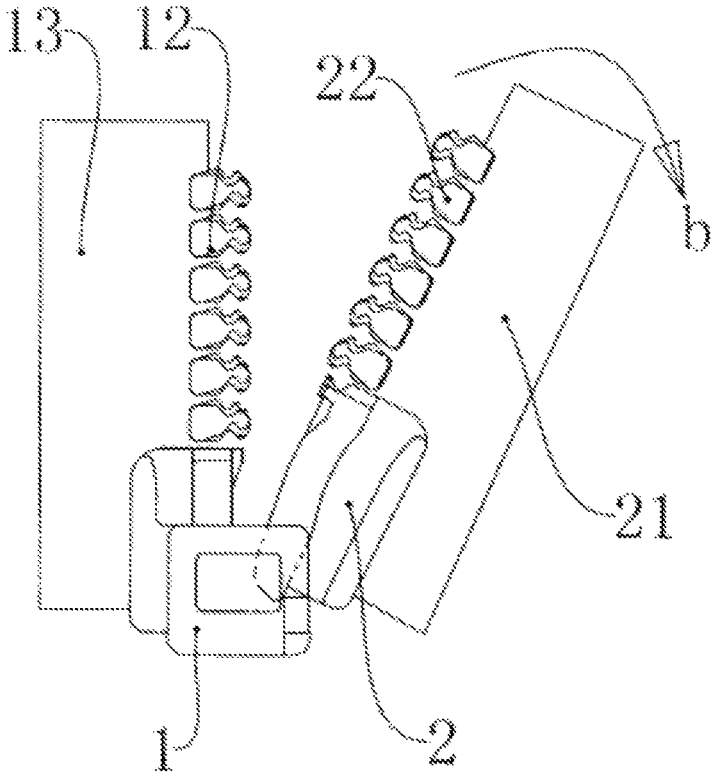
FIG. 7 is a structure diagram of a state during the process of the left stop member 2 retreating from the right stop member 1.

Alternatively, as shown in FIG. 3, FIG. 4, FIG. 5 and FIG. 6, the front end of the lateral notches 18 of the right slot 11 is provided with an upper extension arm 17 and a lower extension arm 16 extending relative to each other. The clearance space between the upper extension arm 17 and the lower extension arm 16 forms a front lateral notch 181 of the right slot 11. The thickness of the inside wall portion 25 of the left stop member 2 is greater than that of the middle transition portion 26 to form inside steps of the left stop member 2. The spacing of the front lateral notch 181 of the right slot 11 is less than the thickness of the inside wall portion 25 but greater than the thickness of the middle transition part 26, while the spacing of the remaining lateral notches 182 of the right slot 11 is greater than the thickness of the inside wall portion 25. According to this solution, the lateral notches 18 of the right slot 11 are actually shaped like steps and comprise the front lateral notch 181 and the remaining lateral notches 182, wherein the spacing of the front lateral notch 181 is less than that of the remaining lateral notches 182. In this way, when the left stop member 2 is inserted into the opening 3 of the right slot 11, the upper extension arm 17 and the lower extension arm 16 can extend into the middle transition part 26, while the inside wall portion 25 can be limited into the front lateral notch 181 and can be released from the remaining lateral notches 182. By the fitting of the inside wall portion 25 and the front lateral notch 181, the strength of the top end portion 23 bearing transverse tensile force is enhanced, so that the transverse tensile strength between the left stop member 2 and the right stop member 1 is improved greatly. When the left stop member 2 needs to retreat from the right slot, as shown in FIG. 7, the top end portion 23 may directly rotate around the step of the front lateral notch 181 after the left stop member 2 retreats the distance of the front lateral notch 181 under the drive of the left slide fastener belt 21, so that the inside wall portion 25 may rotate to come out from the remaining lateral notches 182 immediately (as shown in direction b). It is convenient and quick for the left stop member to retreat from the right slot. In addition, the upper extension arm 17 and the lower extension arm 16 can also improve the structure strength of the lateral notches 18 to prevent the right slot 11 from cracking due to the impact of external force.

To further reduce the obstruction to the retreat of the top end portion 23, alternatively, the thickness of the top end portion 23 may be designed to be less than the spacing of the front lateral notch 181. In this way, when the left stop member 2 retreats, when the inside wall portion 25 retreats from the remaining lateral notches 182, the top end portion 23 may slip off the front lateral notch 181 directly, while the remaining parts of the left stop member 2 may slip off the remaining lateral notches 182 directly.

To be helpful for the positioning of the tail ends of the left stop member 2 and the right stop member 1 in the front, rear, left and right directions, the inside of the tail end of the left stop member 2 is provided with a barb groove 29 that is inclined slightly, while the inside of the tail end of the right stop member 1 is provided with a tail bulge 19 fitted with the barb groove 29. When the left stop member 2 is inserted into the right stop member 1, the barb groove 29 is fastened with the tail bulge 19, so that the barb groove 29 and the tail bulge 19 form fastening devices fastened mutually. The fastening devices fastened mutually can strengthen the positioning strength and stability between the left stop member 2 and the right stop member 1.

Figure 8:
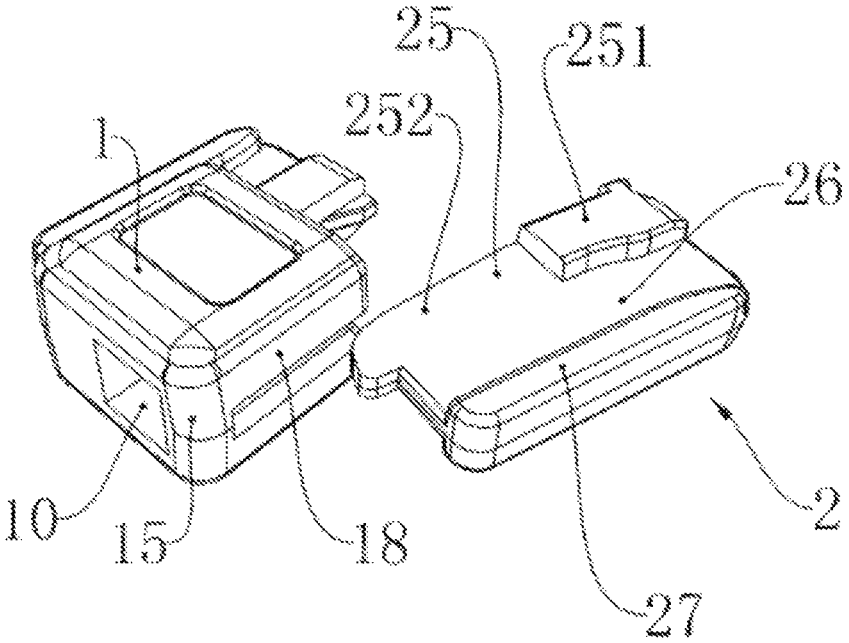
FIG. 8 is a third structure diagram (slide fastener belts and teeth are not shown) of a lower stop assembly for slide fasteners in the invention.
Figure 9:
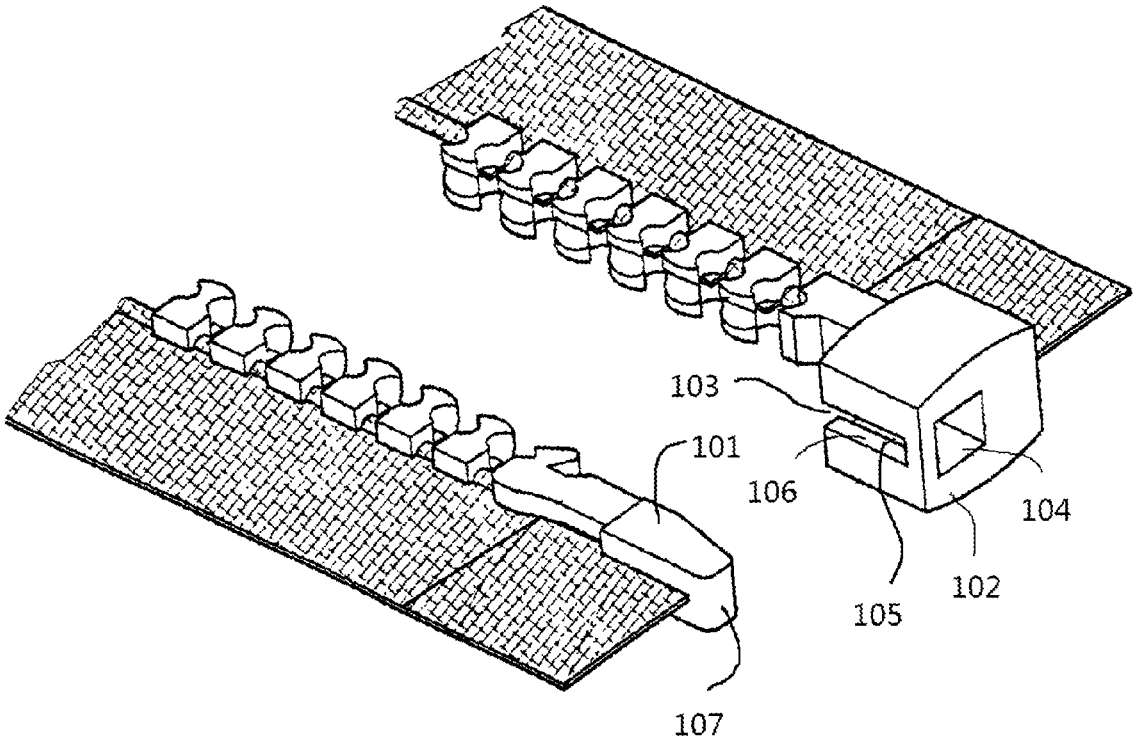
Fig. 9 (Prior Art)
FIG. 9 is a construction diagram of an existing lower stop assembly for slide fasteners.
Figure 10:
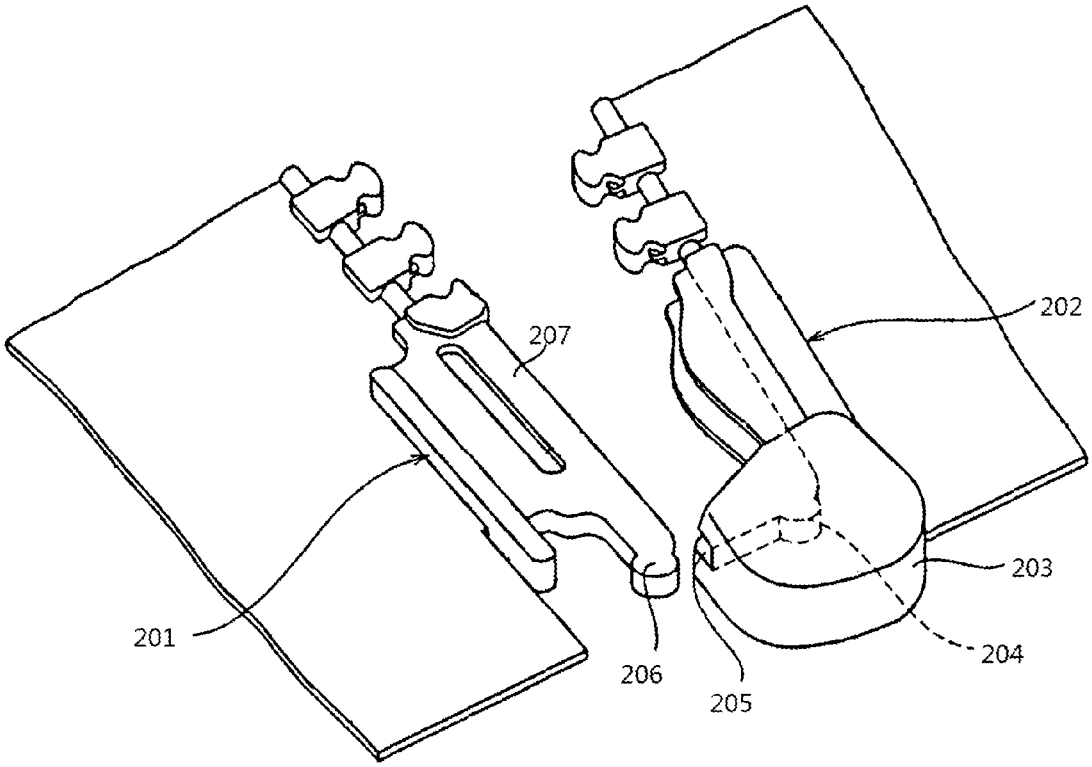
Fig. 10 (Prior Art)
FIG. 10 is a construction diagram of another existing lower stop assembly for slide fasteners.

The third solution may also be as shown in FIG. 8. Differing from the solutions shown in FIG. 3, FIG. 4, FIG. 5 and FIG. 6, the third solution is characterized in that the part of the lateral notches 18 of the right slot 11 is provided with an upper extension arm 17 and a lower extension arm 16 extending relative to each other, the spacing between the upper extension arm 17 and the lower extension arm 16 being roughly the sane, the thickness of the rear part of the inside wall portion 25 of the left stop member 2 being greater than that of the middle transition part 26 so that a rear inside step 251 of the left stop member 2 is formed; and that the spacing of the lateral notches 18 of the right slot 2 is less than the thickness of the rear inside step 251 but greater than the thickness of the middle transition part 26, and also greater than the thickness of the remaining parts 252 of the inside wall portion 25 of the left stop member 2. According to the solution, although the spacing of the lateral notches 18 of the right slot 11 is roughly the same, when the left stop member 2 is inserted into the opening 3 of the right slot 11, the transverse tensile strength between the left stop member 2 and the right stop member 1 is improved greatly by the rear inside step 251 and the top end portion as the rear inside step 251 can be limited in the opening 3 of the right slot 11; and when the left stop member 2 needs to retreat, the left stop member 2 may slip off the lateral notches 18 of the right slot 11 directly after retreating the distance of the rear inside step 251 under the drive of the left slide fastener belt 21, so it is convenient and quick for the left stop member to retreat from the right slot.

What is claimed is:

1. A lower stop assembly for quick release slide fasteners, comprising a left stop member and a right stop member, the outsides of the left stop member and the right stop member being connected with a left slide fastener belt and a right slide fastener belt, respectively, the inside of the right stop member being provided with a right slot and an annular orifice both extending in the direction of the inside, the annular orifice being located at the front end of the right slot and in direct communication with an opening of the right slot, a lateral notch disposed on the right slot facing the inside of the right member, the top end portion of the left stop member being able to be inserted into the annular orifice when the left stop member is inserted into the opening of the right slot, wherein the left stop member comprises: an inside wall portion that can be inserted into the opening of the right slot, an outside wall portion connected with the left slide fastener belt and a middle transition portion located between the inside wall portion and the outside wall portion, the thickness of the inside wall portion of the left stop member being greater than that of the middle transition portion; and a first portion of the lateral notch at a top end of the right stop member of the right slot is provided with an upper extension arm and a lower extension arm at an outer end of the first portion of the lateral notch, the two extension arms extending toward each other, a clearance space of first portion of the lateral notch being less than a thickness of the inside wall portion but greater than a thickness of the middle transition portion, a spacing of a second portion of the lateral notch at a bottom end of the right stop member of the right slot being greater than the thickness of the inside wall portion.

2. The lower stop assembly for slide fasteners according to claim 1, wherein a height of the top end portion is less than a depth of the annular orifice.

3. The lower stop assembly for a slide fastener according to claim 1, wherein the top end inside part of the top end portion is designed into an arched transition shape.

* * * * *